United States Patent [19]

Yorio et al.

[11] 4,107,963

[45] Aug. 22, 1978

[54] KEY AND LOCK SYSTEM

[76] Inventors: Noelle Yorio; Albert E. Yorio, both of 70 West St., Harrison, N.Y. 10528

[21] Appl. No.: 780,662

[22] Filed: Mar. 23, 1977

[51] Int. Cl.[2] ..... E05B 19/06; E05B 35/08

[52] U.S. Cl. ..... 70/337; 70/364 A; 70/409

[58] Field of Search ..... 70/337, 340, 364 A, 70/395, 401, 406, 409

[56] References Cited

U.S. PATENT DOCUMENTS 1,438,336 12/1922 Schroeder ..... 70/364 A

FOREIGN PATENT DOCUMENTS 1,186,776 2/1965 Fed. Rep. of Germany ..... 70/401

*Primary Examiner*—Robert L. Wolfe

*Attorney, Agent, or Firm*—Brumbaugh, Graves, Donohue & Raymond

[57] ABSTRACT

A lock system comprising (1) a first standard size pin-tumbler lock mechanism, such as is used, for example, in an exterior apartment door; (2) a second pin-tumbler lock mechanism substantially smaller in size than the first lock, such as is used for securing an apartment house mailbox; and (3) a key having conventional handle and shank portions, a first set of notches and projections extending along one longitudinal edge of the shank portion such that the key, when properly inserted into the barrel of the standard lock mechanism, will render it operable, and a second set of notches and projections extending partially along the opposite longitudinal edge on the shank at its outer extremity such that when the key is properly inserted into the barrel of the smaller lock mechanism, it will also be rendered operable. The lock system may further comprise a third pin-tumbler lock mechanism of standard size, wherein the key is formed having a rectangular longitudinal projecting ridge along the shank portion, and a third set of notches and projections extending along a protruding edge of the ridge such that the key, when properly inserted in the barrel of the third lock mechanism, will render it operable.

8 Claims, 6 Drawing Figures

FIG. 4
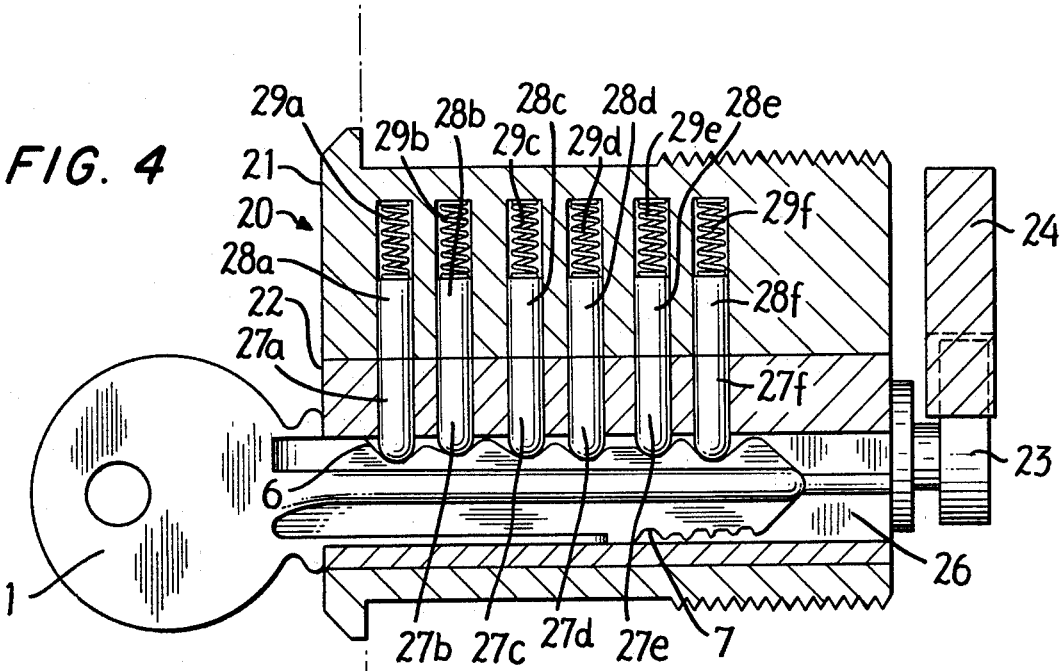
FIG. 6
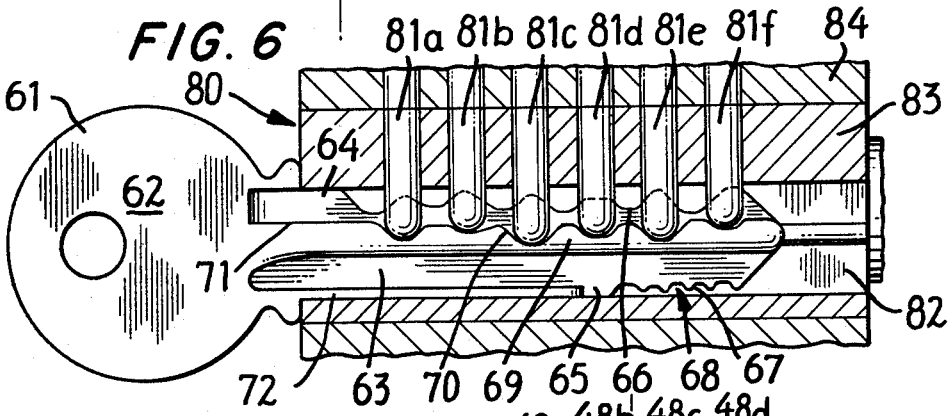
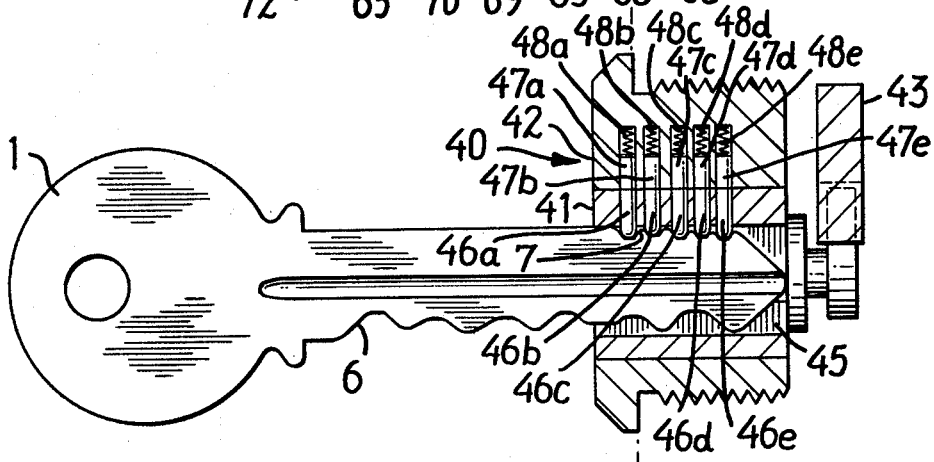
FIG. 5

KEY AND LOCK SYSTEM

BACKGROUND OF THE INVENTION

This invention relates to an improved key and lock system whereby a single key is capable of operating two dissimilar lock mechanisms. The single key according to the invention has conventional handle and shank portions and is so designed such that a first set of notches and projections extending along one entire longitudinal edge of the key shank is used to operate a standard locking device, whereas a second set of notches and projections extending partially along the opposite longitudinal edge of the key shank on its outer extremity is used to operate a second smaller lock having a shorter barrel. The lock and key system according to the invention has particular applicability in multiple dwelling arrangements where a single key for the main exterior access door and for the mailbox unit affords a great convenience.

Normally, in a multiple dwelling apartment or condominium complex, each housing unit requires a standard size pin-tumbler lock mechanism for securing the main exterior door of the unit. In addition, each housing unit is provided with a mail receptable having a lock which is normally substantially smaller in size than the standard size exterior door lock. Moreover, the size of the internal tumblers for the mail receptacle and exterior door locks will differ substantially, and the relative number of tumblers in the locks may vary as well. The smaller size of the mail receptacle lock is necessitated by the physical size of the mailbox itself, while the number of internal tumblers is specified in the present U.S. Postal Services regulations, which requires that the lock be a 5 pin-tumbler type lock (see U.S. Postal Service, Regulations and Manufacturing Standards, Apartment House Mail Receptacles, Publication No. 17, July 1974, effective May 1, 1975).

As a result of the necessity to use substantially different locks, apartment dwellers and condominium owners have found it necessary to carry two separate keys to permit access to their apartments and mailboxes, which has been found to be in some cases a substantial inconvenience.

Various arrangements have been proposed in the past for operating more than one lock with a single key. The most well-known is the so-called "master key" device. In such a device, a lock is operable by either of two separate key configurations. A series of basically similar locks in size and tumbler number may be so designed and constructed that one of the key configurations is common to all of the locks (the master key arrangement), and the other configuration varies with each lock. A typical "master key" arrangement is shown in U.S. Pat. No. 2,039,126 to Svoboda.

Another arrangement permitting the use of one key in more than one lock configuration is disclosed in U.S. Pat. No. 1,438,336 to Schroeder. A flat key is provided with two sets of notches and projections along its two longitudinal edges. The first set of notches and projections actuates the tumblers in a first lock mechanism and thus renders the lock operable. When the key is inserted upside down into a second lock mechanism having a similar lock barrel, it actuates the tumblers in the second lock so as to render that lock operable as well.

Although the aforementioned devices disclose lock systems where one key operates two locks, in each case the two locks are substantially similar. In the master key arrangement, the portion of the lock which the master key operates is in fact identical in each lock. In the device shown in the Schroeder U.S. Pat. No. 1,438,336, each lock must have substantially the same barrel and thereby differ only in the setting (length) of the tumblers. Neither configuration permits the use of two substantially different size lock mechanisms with a single key.

SUMMARY OF THE INVENTION

This invention provides a key-lock system whereby a single key operates two different size lock mechanisms. More specifically, the invention provides (a) a first pin-tumbler lock mechanism having a key slot and barrel, and tumbler pins projecting into the barrel for operating the lock mechanism; (b) a second pin-tumbler lock mechanism, substantially smaller in size than the first, having a somewhat shorter key slot and barrel, and tumbler pins projecting into the barrel for operation of the second lock mechanism in substantially the same manner as the first; and (c) a key having a conventional handle portion and shank portion with (i) a set of notches and projections extending along one longitudinal edge of the shank which when properly inserted into the key slot and barrel of the first pin-tumbler type lock will engage the tumbler pins thereof so as to render the lock operable, and (ii) a second set of notches and projections extending partially along the opposite longitudinal edge at its outer extremity which when properly inserted into the key slot and barrel of the second smaller pin-tumbler type lock will likewise render the smaller lock operable.

The invention further provides a key lock system wherein the key is capable of operating a third lock mechanism. More specifically, the key is formed with a rectangular longitudinal projecting ridge along its shank portion, the ridge having a third series of notches and projections along a protruding edge of the ridge. The third lock mechanism is provided with a key slot and barrel and tumbler pins projecting into the barrel, the tumbler pins radially offset so as to engage the third set of notches and projections when the key is properly inserted.

BRIEF DESCRIPTION OF THE DRAWINGS

For the purpose of illustrating the invention, reference is made to the accompanying drawings, in which:

FIG. 4 is a cross-sectional view of the standard exterior door lock shown in FIG. 2 with a key inserted, taken along line 4—4;

FIG. 5 is a cross-sectional view of the mail receptacle lock shown in FIG. 3 with a key inserted, taken along line 5—5; and FIG. 6 is a cross-sectional view of a second exterior door lock with another key formed according to the present invention inserted.

DESCRIPTION OF THE PREFERRED EMBODIMENTS

Figure 1:
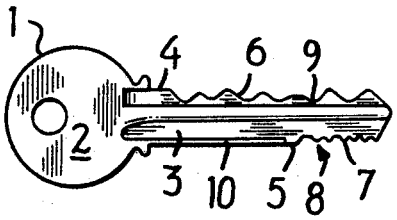
FIG. 1 is a side elevation of a typical key formed according to the present invention.
Figure 2:
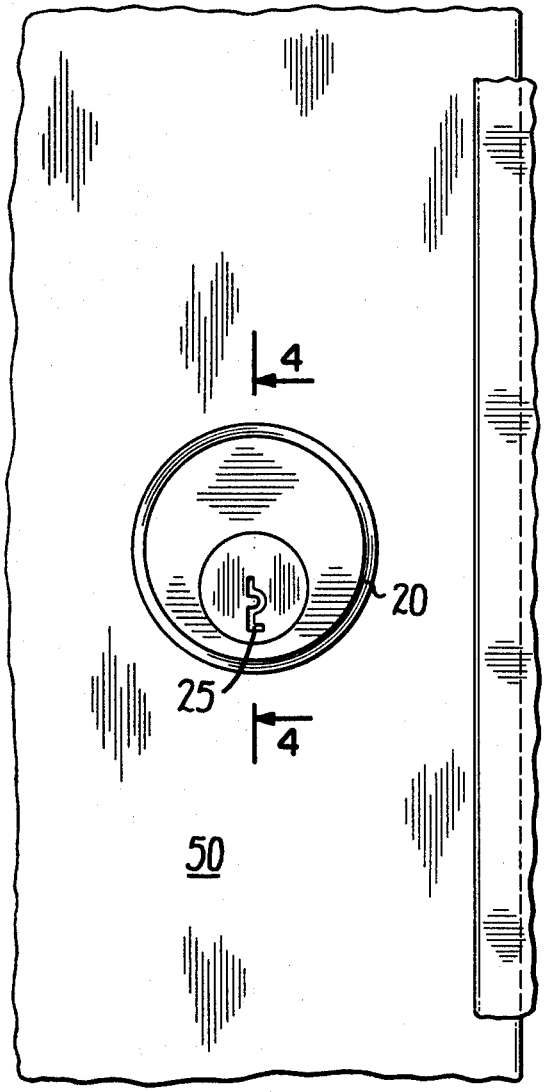
FIG. 2 is an end elevation of a standard exterior door lock with the key removed.
Figure 3:
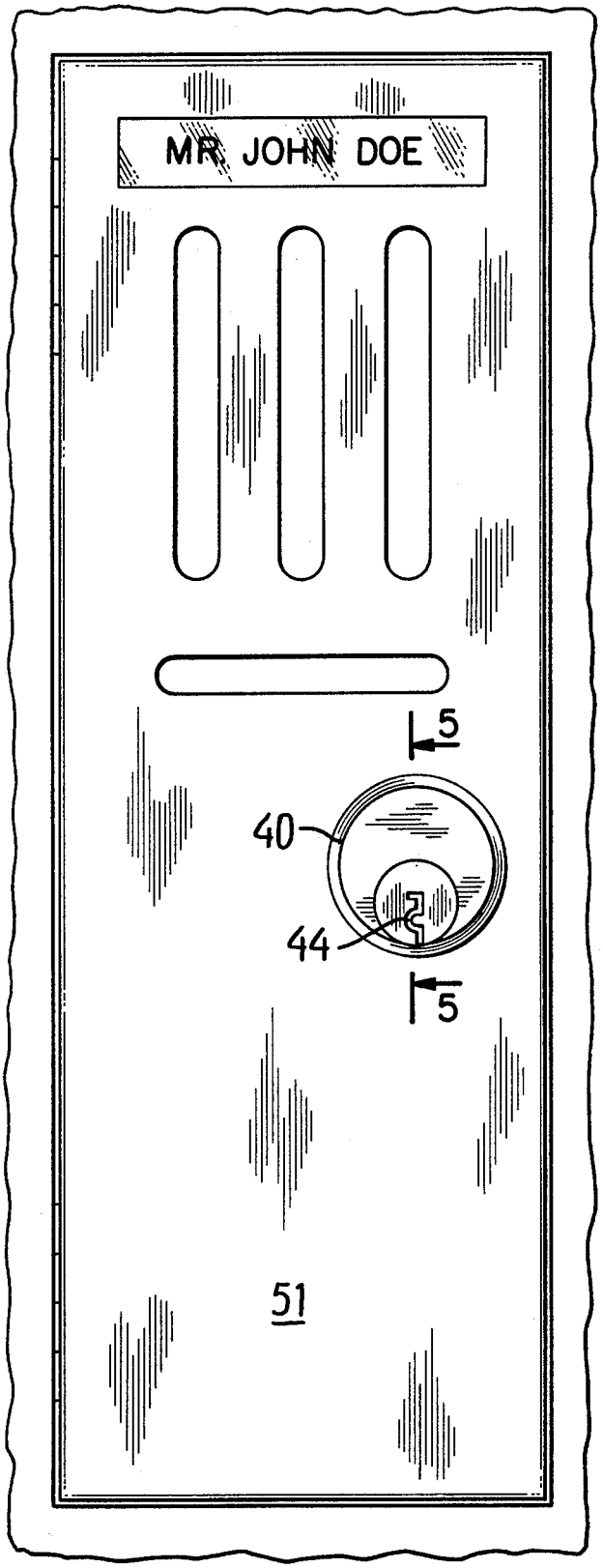
FIG. 3 is an end elevation of a smaller lock for a United States mail receptacle as presently in use with the key removed.

Referring to the drawings, a lock system embodying the present invention is shown comprising a key member 1, a first lock mechanism 20, and a second lock mechanism 40, the second lock mechanism 40 being substantially smaller in size and shorter in barrel depth than the first lock mechanism 20.

As seen in FIG. 1, the key 1 is formed in the conventional manner with a handle portion 2 and a shank portion 3 having longitudinal edges 4 and 5. The shank 3 has sufficient length so that longitudinal edges 4 and 5 will permit normal operation of lock mechanisms 20 and 40. The key is formed with a first set of notches and projections 6 extending along substantially the entire length of one longitudinal edge 4 on the shank 3, and a second set of notches and projections 7 partially extending along the opposite longitudinal edge 5 on the shank 3 at its outer extremity 8. The second set of notches and projections 7 extends a distance from the end of the shank 3 approximately equal to the barrel depth of the smaller lock mechanism 40 for the cooperation therewith. The key may also be formed with a longitudinal groove 9 along the length of the shank 3, and a flange 10 extending along the edge 5, to a point contiguous to the notches and projections 7, to enable the locking mechanism to provide every available security.

Key 61 is substantially similar to key 1, with a handle portion 62 and shank porton 63, the shank portion 63 having longitudinal edges 64 and 65. The shank 63 has sufficient length so that longitudinal edges 64 and 65 will permit normal operation of lock mechanisms 20, 40 and 80. The key is formed with a first set of notches and projections 66 extending along substantially the entire length of one longitudinal edge 64 on the shank 63, and a second set of notches and projections 67 partially extending along the opposite longitudinal edge 65 on the shank 63 at its outer extremity 68. The second set of notches and projections 67 extends a distance from the end of the shank 63 approximately equal to the barrel depth of the smaller lock mechanism 40 for cooperation therewith. The key 61 is also formed with a rectangular longitudinal projecting ridge 69 along the length of the shank 63. A third set of notches and projections 70 is formed along one protruding edge 71 of the ridge 69. The key may also be formed with a flange 72 extending along edge 65, similar to the flange 10 of key 1.

As best seen in FIG. 4, the first lock mechanism 20 is comprised of an outer cylinder 21 and an inner cylinder 22. The inner cylinder 22 rotates a lug 23 which actuates the lock bolt 24. The inner cylinder 22 has a key slot 25 which permits insertion of the key 1 or key 61 into the barrel 26. A series of tumblers comprising pins 27*a–f* and corresponding plungers 28*a–f* traverse the outer cylinder 21 and inner cylinder 22 and are normally urged downward by corresponding springs 29*a–f* into the barrel 26 of the inner cylinder 22. The lock mechanism 40 likewise has inner and outer cylinders, 41 and 42 respectively, where the rotating inner cylinder 41 operates the lock bolt 43 in substantially the same manner as in lock mechanism 20. Accordingly, the lock mechanism 40 is provided with a key slot 44 which also permits insertion of the key 1 or 61 into the barrel 45. A series of tumblers comprising pins 46*a–e* and corresponding plungers 47*a–e* which traverses the cylinders 41 and 42 and are normally urged downward into the barrel 45 of the inner cylinder 41 by a series of springs 48*a–e*. The key barrels 26 and 45 of the lock mechanism, 20 and 40 respectively, are formed to correspond to the longitudinal groove 9 and flange 10 of the key 1 or rectangular longitudinal projecting ridge 69 and flange 72 of the key 61, such that upon proper insertion of the key 1 or 61 into the barrel 26 or lock 20, the notches and projections 6 or 66 will effectively engage the lock pins 27*a–e*, and by proper insertion of the key 1 or 61 into the barrel 45 of lock 40, the notches and projections 7 or 67 will engage the lock pins 46*a–e*.

Lock mechanism 80, illustrated in FIG. 6, is substantially similar to lock mechanism 20, except that the tumblers 81*a–f* of lock mechanism 80 which traverse the inner and outer cylinders, 83 and 84 respectively, are positioned to be radially offset in the barrel 82 so as to engage the third set of notches and projections 70 of key 61 when the key is properly inserted into the barrel 82.

In operation, the lock mechanism 20 is secured in the exterior door 50 of a housing unit and the lock 40 is attached to the door of the mailbox 51 assigned to the same housing unit. When the key 1 or 61 is inserted through the slot 25 into the barrel 26 of the lock 20, the notches and projections 6 or 66 engage the lock pins 27*a–f* forcing the lock pins 27*a–f* and thereby the corresponding plungers 28*a–f* outwardly in a predetermined fashion. The notches and projections 6 or 66 displace the pins and plungers through a predetermined distance so that the inner cylinder 22 of the lock 20 will rotate freely upon a corresponding rotation of the key. The longitudinal groove 9 and flange 10 of key 1 or the rectangular longitudinal projecting ridge 69 and flange 72 of key 61 assure that the key will be accurately aligned when inserted in the barrel 26. Upon removal of the key 1 or 61, the springs 29*a–f* force the pins 27*a–f* and plungers 28*a–f* downwardly thus rendering the lock inoperable.

Similarly, the mailbox lock 40 is operated by inserting the key 1 or 61 through the slot 44 into the barrel 45, thereby engaging the pins 46*a–e*. The notches and projections 7 or 67 force the pins 46*a–e* and plungers 47*a–e* outwardly a distance allowing the inner cylinder 41 to rotate freely with rotation of the key, thus operating the lock bolt 43. Upon removal of the key, the springs 48*a–e* urge the plungers downwardly into the cylinder, thus rendering the lock inoperable.

Lock mechanism 80 is secured in the exterior door of a multiple dwelling apartment or condominium building. When the key 61 is inserted into the barrel 82, the third set of notches and projections 70 engage the tumblers 81*a–f* and displace them a predetermined distance so that the inner cylinder 83 will rotate freely and thus render the lock operable in the same manner as lock mechanism 20.

The embodiment of the invention described herein is merely illustrative and the invention may be embodied in other forms while still employing the invention principles contained herein. Thus, the key-lock system according to the invention could be used to provide a single key for a car trunk, ignition, and doors using different locks, and for different locks to a boat ignition and cabin door and the like.

All such modifications and variations are intended to be within the scope of the invention as defined in the following claims.

We claim:

1. A lock system comprising a combination of (1) a first pin-tumbler lock having an outer cylinder and a rotating inner cylinder, the inner cylinder having a key slot and barrel, and tumblers comprising lock pins and corresponding plungers traversing the inner and outer cylinders, wherein the lock pins project into the barrel;

(2) a second pin-tumbler lock, substantially shorter in size than the first lock, having an outer cylinder and a rotating inner cylinder, the inner cylinder having a key slot and barrel, and tumblers comprising lock pins and corresponding plungers traversing the inner and outer cylinders, wherein the lock pins project into the barrel; and (3) a key having a conventional handle portion and shank portion with a first series of notches and projections extending along one longitudinal edge of the shank portion which engage the tumbler pins of the first pin-tumbler lock upon insertion of the key so as to render the lock operable, and having a second series of notches and projections extending partially along the opposite longitudinal edge of the shank at its outer extremity which engage the tumbler pins of the second pin lock upon insertion of the key to render the second lock operable.

2. A lock system according to claim 1, where the first pin-tumbler lock is a standard apartment size lock mechanism, and the second lock is a five pin-tumbler standard mailbox lock.

3. A lock system as in claim 1, wherein the key is formed with a longitudinal groove along the length of the shank portion and with a flange along the opposite longitudinal edge and contiguous to the second series of notches and projections, and each lock having a barrel and key slot formed correspondingly to accept such key.

4. A lock system as in claim 2, wherein the key is formed with a longitudinal groove along the length of the shank portion and a flange along the opposite longitudinal edge contiguous to the second series of notches and projections, and each lock having a barrel and key slot formed correspondingly to accept such key.

5. A lock system as in claim 1, further comprising a third pin-tumbler lock having an outer cylinder and a rotating inner cylinder, the inner cylinder having a key slot and barrel, and tumblers comprising lock pins and corresponding plungers traversing the inner and outer cylinders, the tumblers radially offset in the barrel, and wherein the key is formed with a rectangular longitudinal projecting ridge along the shank portion, the ridge having a third series of notches and projections extending along a protruding edge of the ridge which engage the tumbler pins of the third pin-tumbler lock upon insertion of the key so as to render the lock operable.

6. A lock system according to claim 5, wherein the first pin-tumbler lock and the third pin-tumbler lock are standard apartment size lock mechanisms, and the second lock is a five pin-tumbler standard mailbox lock.

7. A lock system as in claim 5, wherein the key is formed with a flange along the opposite longitudinal edge and contiguous to the second series of notches and projections, and each lock having a barrel and key slot formed correspondingly to accept such key.

8. A lock system as in claim 6, wherein the key is formed with a flange along the opposite longitudinal edge contiguous to the second series of notches and projections, and each lock having a barrel and key slot formed correspondingly to accept such key.

* * * * *